US007640897B2

(12) United States Patent
Gandrud et al.

(10) Patent No.: US 7,640,897 B2
(45) Date of Patent: Jan. 5, 2010

(54) FAN DESIGN AND METHOD OF OPERATING

(75) Inventors: Michael D. Gandrud, Ames, IA (US); Chad J. Daniel, Ankeny, IA (US); Simon L. Nielsen, Avoca, IA (US); Jeff L. Herrin, Ankeny, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 167 days.

(21) Appl. No.: 11/937,712

(22) Filed: Nov. 9, 2007

(65) Prior Publication Data

US 2009/0038564 A1 Feb. 12, 2009

Related U.S. Application Data

(60) Provisional application No. 60/954,651, filed on Aug. 8, 2007.

(51) Int. Cl.
*F01P 7/10* (2006.01)
*F01D 1/24* (2006.01)
*B60H 1/00* (2006.01)

(52) U.S. Cl. ..... 123/41.49; 165/41; 415/60

(58) Field of Classification Search ..... 123/41.49, 123/41.12; 62/244; 180/68.1; 165/41; 415/228, 415/60, 61, 66, 68
See application file for complete search history.

(56) References Cited

U.S. PATENT DOCUMENTS 1,876,595 A * 9/1932 Beldimano ..... 415/60
4,651,922 A * 3/1987 Noba ..... 236/35
5,649,587 A 7/1997 Plant
6,155,335 A 12/2000 Acre et al.
6,491,502 B2 12/2002 Hunt
6,494,052 B1 * 12/2002 Lee ..... 62/244
6,523,507 B2 2/2003 Schmitz et al.
6,622,783 B2 9/2003 Hitt et al.
6,752,587 B2 6/2004 Lin et al.
6,817,831 B2 11/2004 Stevens et al.
7,137,775 B2 * 11/2006 Hopkins ..... 415/61
7,293,960 B2 * 11/2007 Yamamoto et al. ..... 416/85
7,406,835 B2 * 8/2008 Allen et al. ..... 62/179
2003/0136544 A1 7/2003 Albright et al.
2004/0012125 A1 1/2004 Plant et al.
2006/0254291 A1 11/2006 Allen et al.
2006/0254292 A1 11/2006 Allen et al.

OTHER PUBLICATIONS

Brezonick, Mike; Exploring the Potential of a "Mini-Hybrid" Transit Bus, Electrification of Cooling System Seen to Provide Significant Improvements in Fuel Economy; Diesel Progress North American Edition Feb. 2007; Engineered Machined Products (EMP, Inc.); Escanaba, MI.

* cited by examiner

*Primary Examiner*—Noah Kamen

(57) ABSTRACT

A method of cooling a radiator in an internal combustion engine wherein a plurality of fan assemblies is provided. Specifically, each fan assembly has a housing with an interior containing a fan blade and an exterior having six sides to form a hexagonal perimeter. The fan assemblies are then arranged side by side to form a cluster of fan assemblies in order to maximize the amount of fan assemblies that may be provided on an enclosure. The cluster of fan assemblies is then placed adjacent to a radiator to control the air flow over the radiator in order to cool the engine.

8 Claims, 9 Drawing Sheets

FAN DESIGN AND METHOD OF OPERATING

CROSS REFERENCE TO RELATED APPLICATION

This application claims the benefit of U.S. Provisional Application No. 60/954,651 filed Aug. 8, 2007.

BACKGROUND OF THE INVENTION

This invention relates to hydraulically powered vehicles. More specifically, this invention relates to electric fans used to cool an engine of an internal combustion engine powered vehicle.

Electrically powered engine cooling fans as shown in FIGS. 1 and 2 are known in the art. Typically, the fan is within a cylindrical housing and uses a series of mounting tabs to mount a cluster of fans on some type of enclosure or body. The body or enclosure guides air flow over a radiator or radiators that are associated with an internal combustion engine, air condition system, or the like. Specifically, the fans are arranged in a side by side position with space in between.

Because the fans of the prior art must be attached to a larger surface such fans are necessarily spaced a distance apart on the enclosure surface so that the enclosure surface will maintain sufficient strength and rigidity to support the fans. Thus, there exists a need in the art for an improved fan design that can be packed efficiently.

Another problem with the present fans set up is that this configuration results in poor aerodynamic performance of the fan assembly. Specifically, air cannot flow smoothly into the fan assemblies using this fan arrangement.

BRIEF SUMMARY OF THE INVENTION

A method and apparatus for cooling a radiator of an internal combustion engine. The apparatus contains a plurality of fan assemblies wherein each fan assembly has a housing with an interior than contains a fan blade and an exterior with six sides to form a hexagonal perimeter. The plurality of fan assemblies are placed adjacent one another such that a first side of a first fan assembly is adjacent or interconnected to the first side of a second fan assembly in order to form a cluster of fan assemblies. The cluster of fan assemblies is then placed adjacent a radiator in order to control the air flow over the radiator thus cooling the engine.

DESCRIPTION OF THE PREFERRED EMBODIMENT

Figure 1:
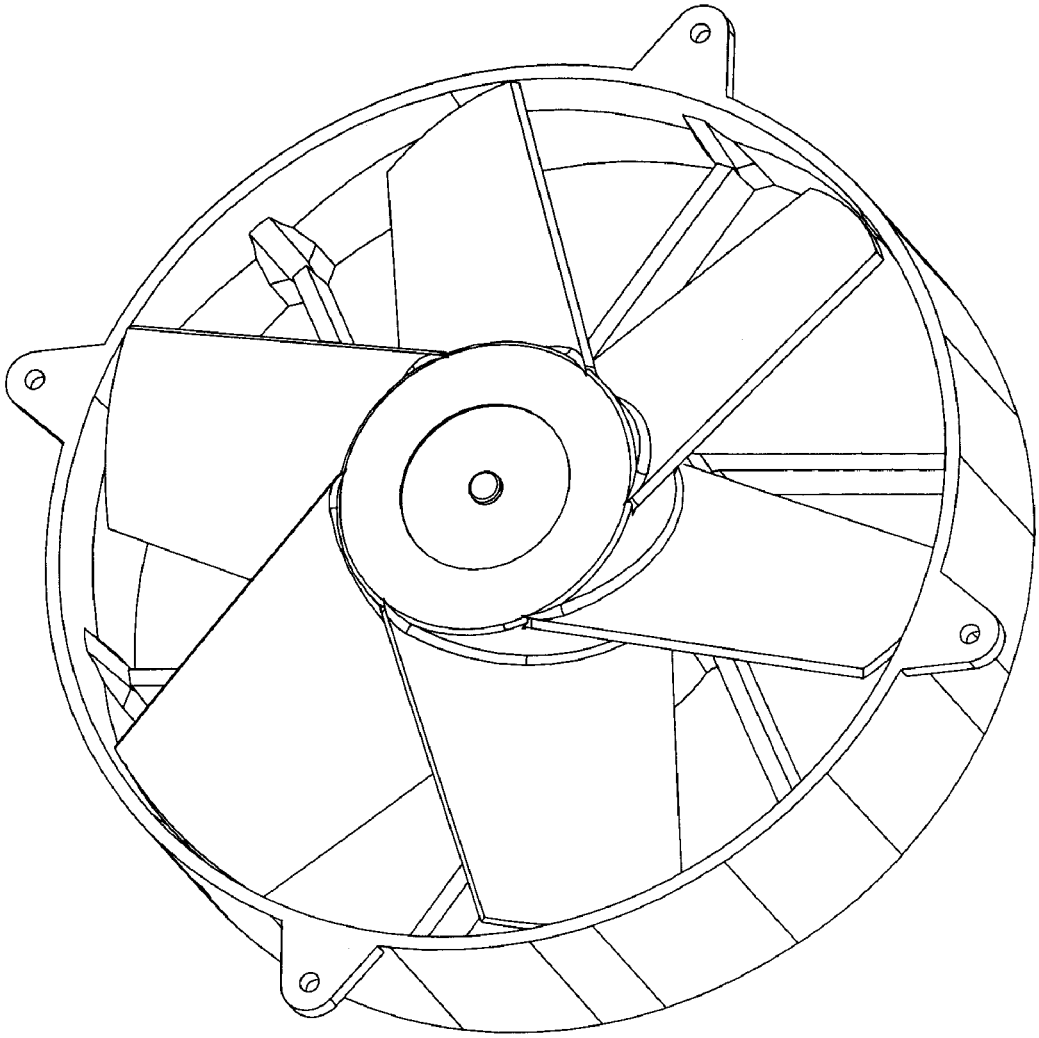
FIGURE 1 PRIOR ART
FIG. 1 is a prior art perspective view of a fan assembly.
Figure 2:
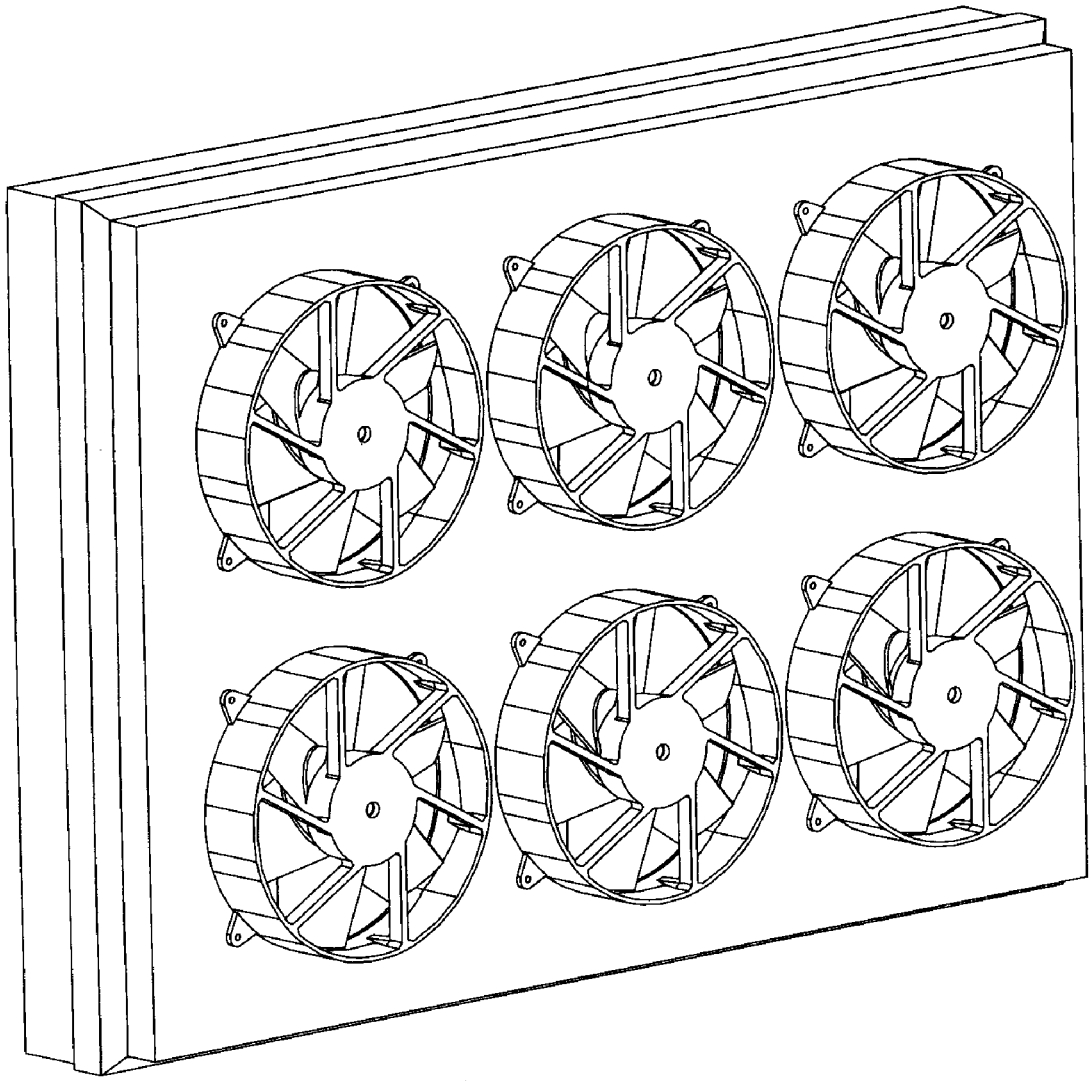
FIGURE 2 PRIOR ART
FIG. 2 is a prior art perspective view of a plurality of fan assemblies arranged together.
Figure 3:
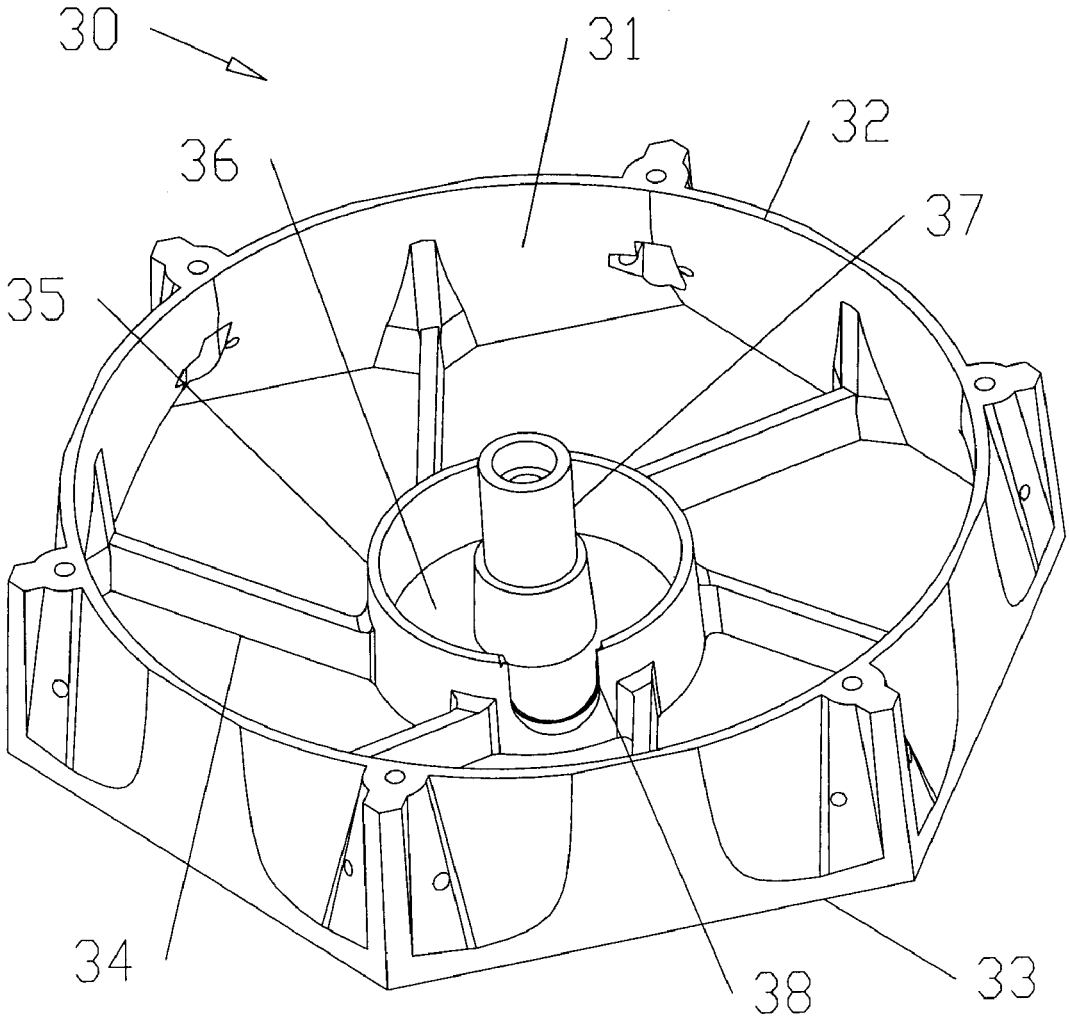
FIG. 3 is a perspective view of a fan assembly.
Figure 4:
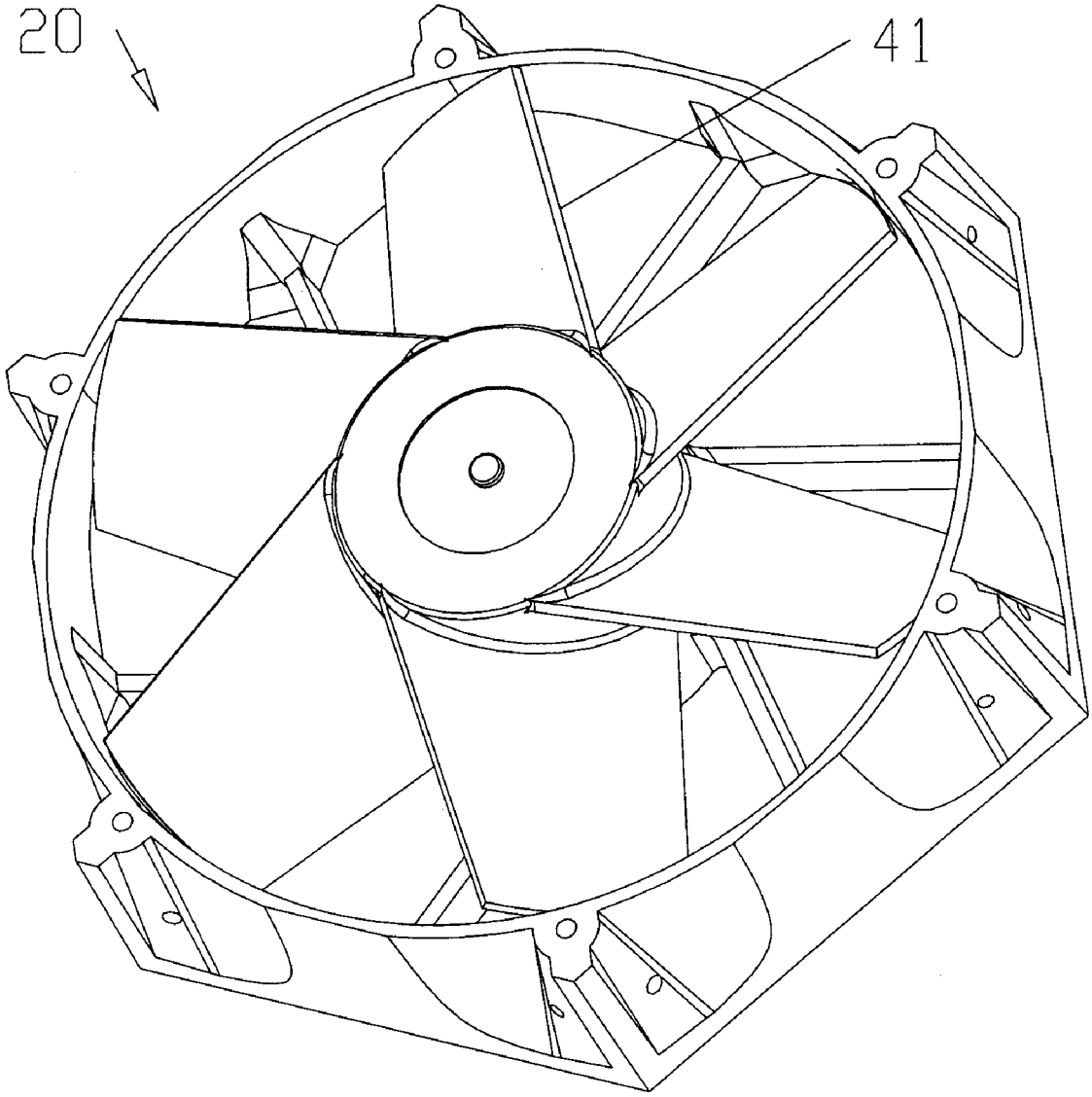
FIG. 4 is a perspective view of a fan assembly.

FIGS. 3 and 4 show a fan assembly 20 having a housing 30. Housing 30 comprises a shroud portion 31 with a substantially circular inner diameter 32 designed to encompass a fan blade, a hexagonal portion 33 designed to facilitate interconnection of adjacent fan units, a plurality of spokes 34 that connect a central motor housing 35 to the shroud portion 31 of the housing 30. Housing 30 additionally comprises a pocket 36 and a spindle 37 that serves to support a motor and optional electronic circuit. A cutout slot 38 is optionally provided for installation of an electrical or other power connector that will provide power to the fan assembly. Alternatively, slot 38 is optionally used for other power or control connector such as a hydraulic or pneumatic tubing connector. The housing 30 additionally contains a fan blade 41 for controlling the flow of air through the assembly.

Figure 5:
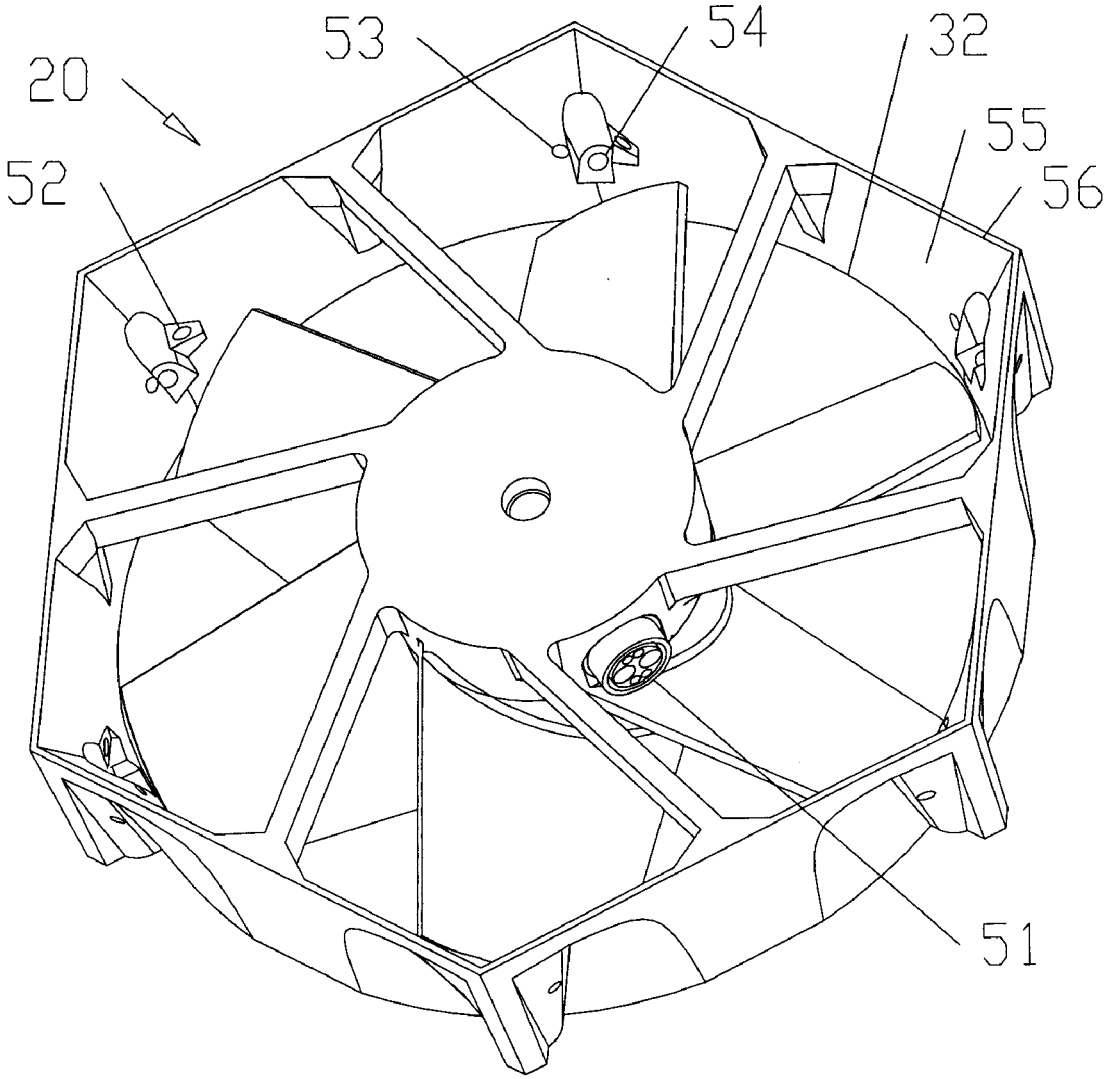
FIG. 5 is a perspective view of a fan assembly without a fan blade.

FIG. 5 illustrates how an electrical connector 51 is located in the provided cutout slot 38 in the housing 30. FIG. 5 also teaches that a plurality of thru holes 52 and optionally a plurality of tapped holes 53 are provided for assembling one fan to another fan in an array. Additionally, a plurality of axial holes 54 are provided for affixing the fan assembly 40 to a suitable enclosure. Also, an aerodynamic arcuate or curved surface 55 is provided to transition from a hexagonal inner diameter 56 on the back of the fan assembly to a circular inner diameter 32 on the front of the fan.

Figure 6:
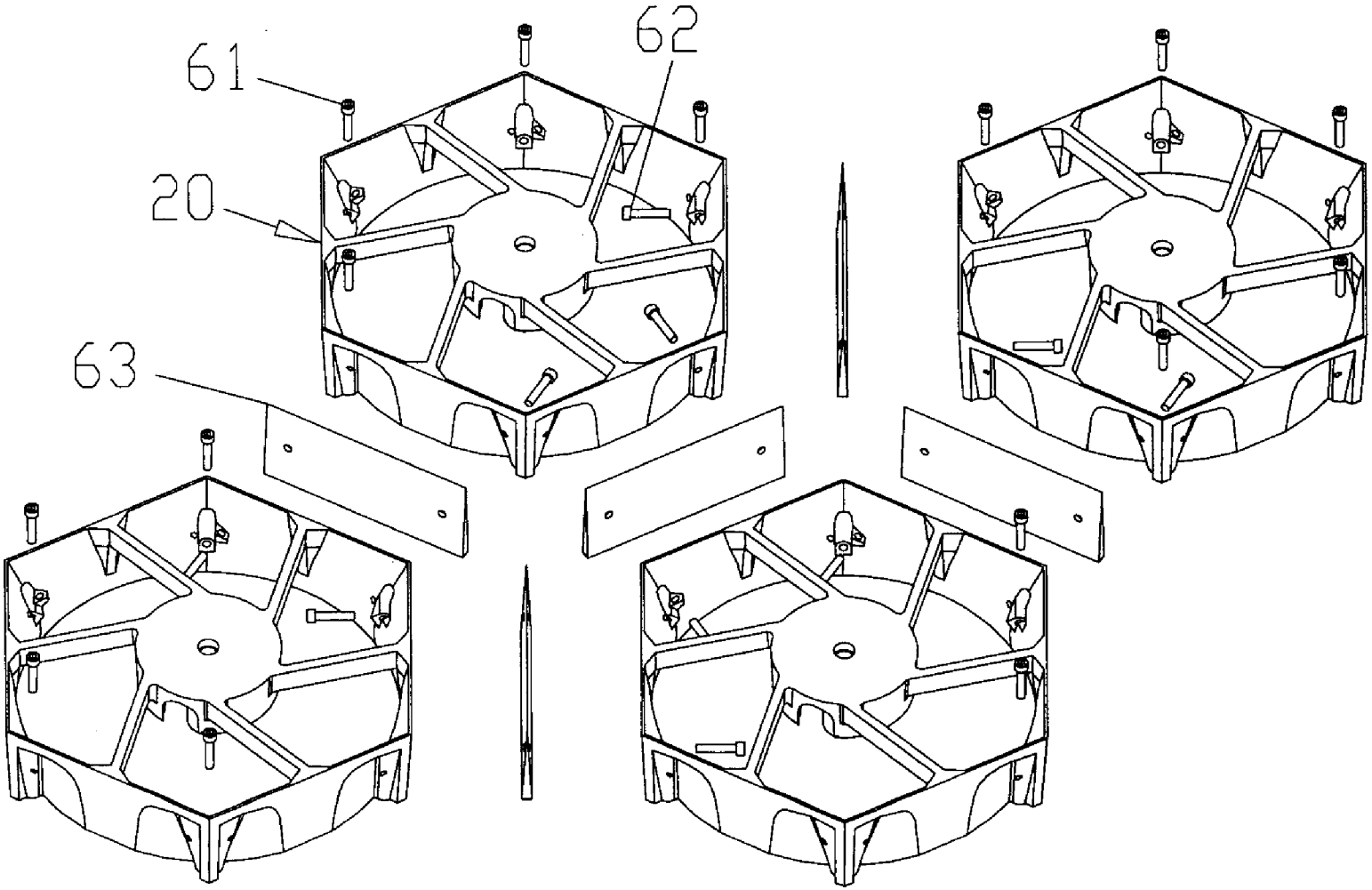
FIG. 6 is an exploded perspective view of a plurality of fan assemblies.
Figure 7:
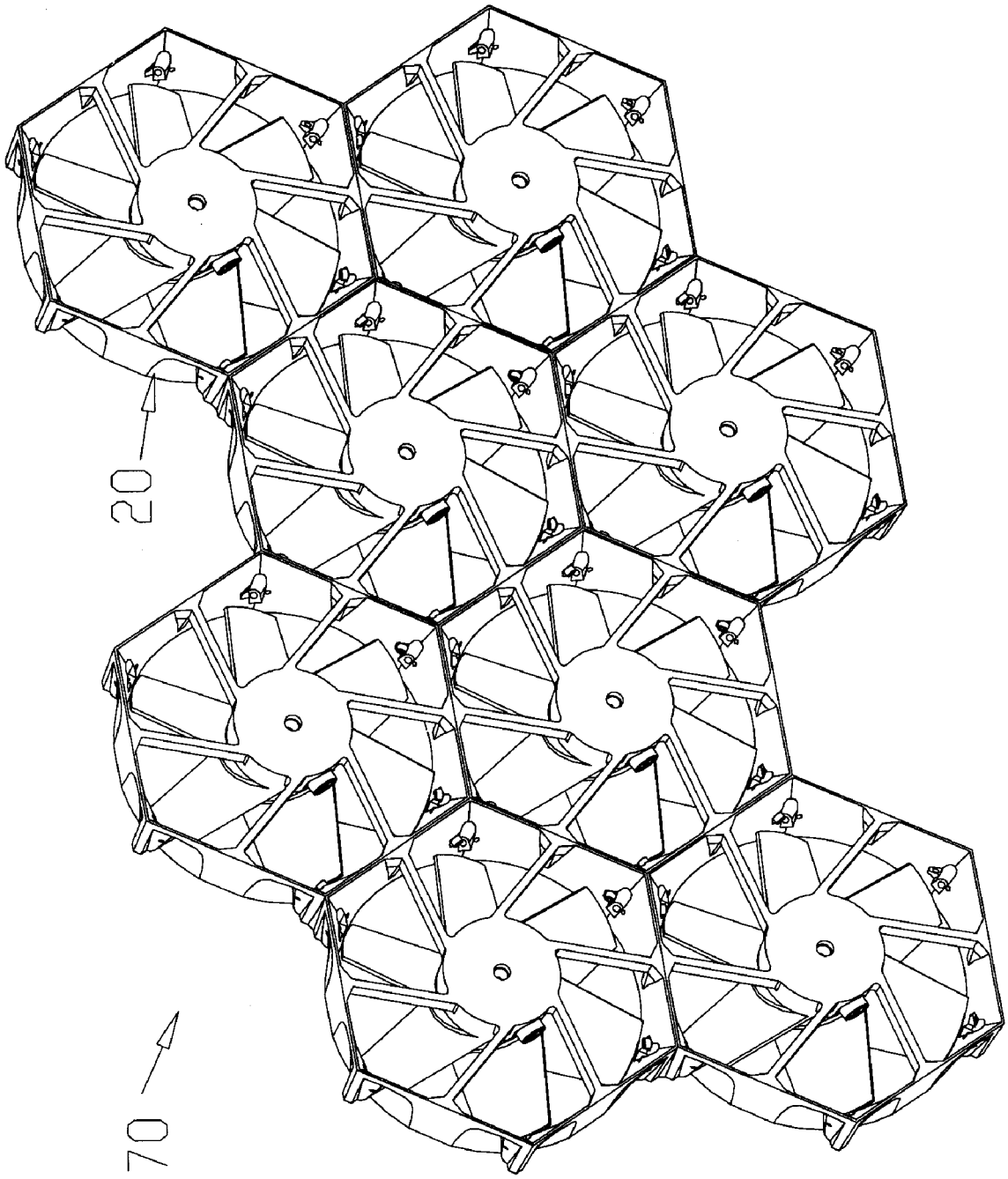
FIG. 7 is a side plan view of a plurality of interconnected fan assemblies forming a cluster of fan assemblies.
Figure 8:
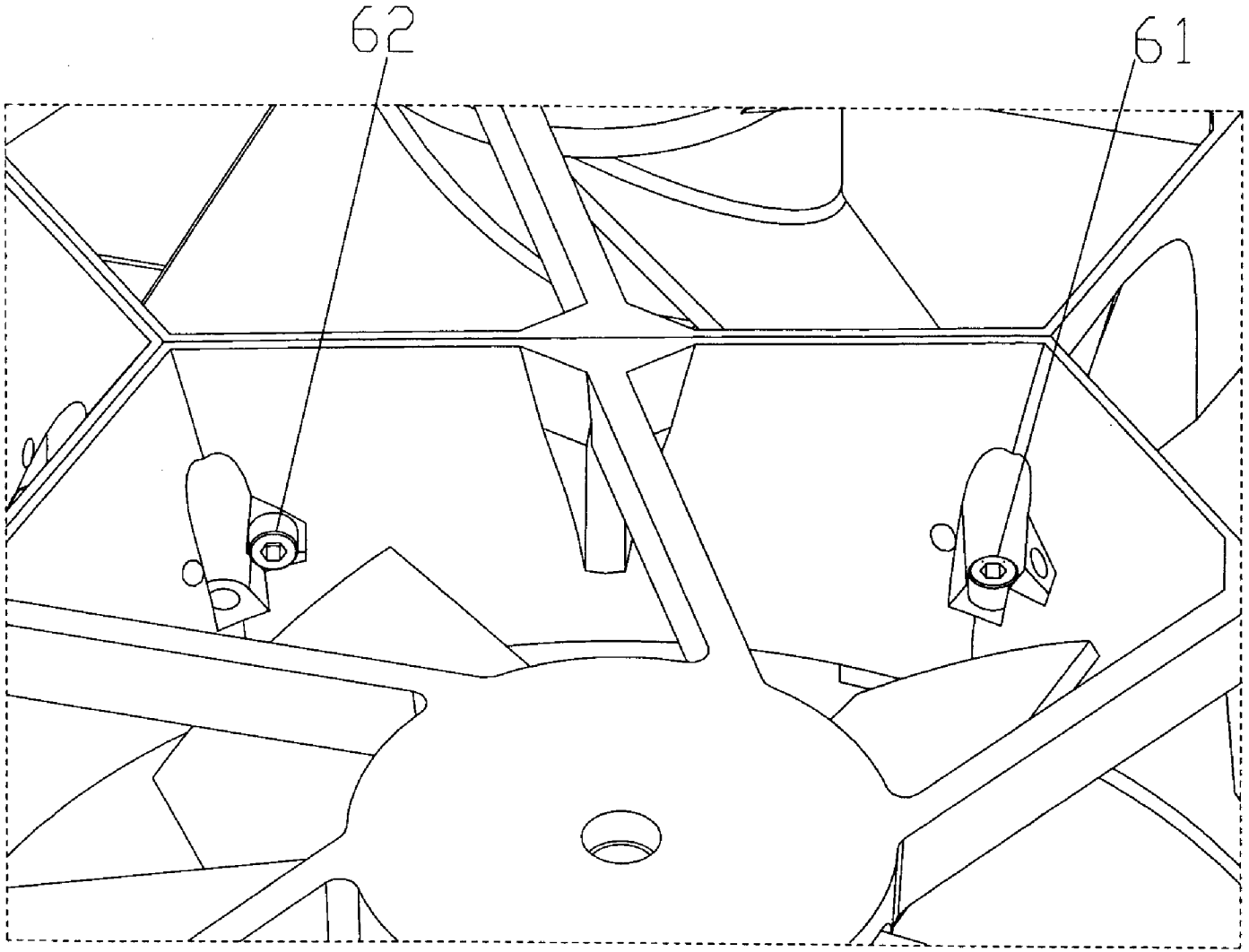
FIG. 8 is side cutout perspective view of a fan assembly.
Figure 9:
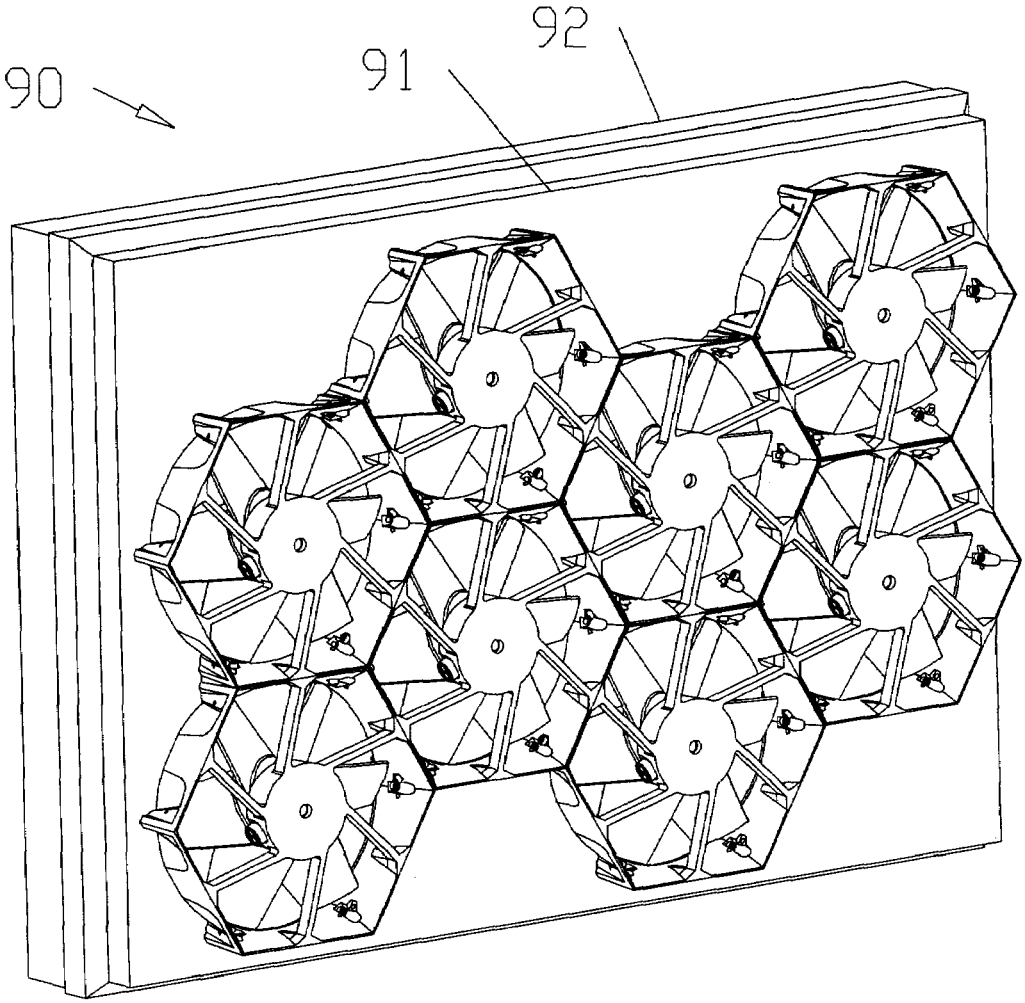
FIG. 9 is a side perspective view of a cluster of fan assemblies adjacent a radiator.

FIG. 6 is an exploded view of an assembly of several fan assemblies or units 20. The exploded assembly comprises several fan assemblies 20, a plurality of axial bolts 61 that affix the fan assembly to an enclosure, a plurality of transverse bolts 62 that affix one fan unit to another, and optionally, if the fan assemblies or units are designed with sides that are not perpendicular to the face, a plurality of wedges 63 that space the fan sides. Fan blades are omitted from FIG. 6 for clarity. Similarly, FIG. 7 illustrates an assembly 70 of eight fan units 20. FIG. 8 illustrates the interconnection of three fan units with bolts 61 and the connection to an enclosure with bolts 62. FIG. 9 illustrates the assembly 90 of eight fans 20 of the present design that are assembled to a five sided enclosure 91 that serves to duct the air flow from the fans through at least one radiator 92.

In operation an assembly 70 or 90 having a plurality of fan assemblies 20 is placed within an internal combustion engine powered vehicle adjacent a plurality of radiators. An electronic control circuit can then be adapted to determine the level of cooling that is required by each radiator and adjust the rotational speed of each fan to provide improved and desired cooling of each radiator without excessively cooling the radiator. Similarly, in times of low cooling demand one or more fan assemblies 70 or 90 are deactivated or run at reduced speed within the assembly 70 or 90.

In this manner, one may place a cluster of multiple fans adjacent to desired radiators in order to control the flow of cooling air over the radiators independently. For instance, in some vehicles an engine coolant radiator may be placed next to a transmission oil cool radiator and next to a charge air cooling radiator. Thus, a cluster of fans or an assembly 70 or 90 may be placed at each such that each assembly 70 or 90 may be controlled independently for desired cooling. The assembly 70 or 90 may be powered by direct current electricity, alternately currently electricity, single phase electricity, three phase electricity, poly phase electricity, flow of hydraulic fluids, flow of pressurized air, steam power, direct mechanical drive, mechanical built drive, or the like without falling outside the scope of this description.

Thus, the assembly 70 or 90 overcomes the shortcomings of prior art by providing cooling fans that are substantially hexagonal in shape. The hexagons are efficiently arranged in a "tiled" manner to completely and efficiently cover an area. Additionally, clusters of fans may be used independently in order to control air flow over separate individual radiators associated with an engine air conditioning system, hybrid drive system, or other fluid cooled electrical component or system. Thus, at the very least all of the stated objectives have been met.

It will be appreciated by those skilled in the art that other various modifications could be made to the device without departing from the spirit in scope of this invention. All such modifications and changes fall within the scope of the claims and are intended to be covered thereby.

What is claimed is:

1. A method of cooling a radiator of an internal combustion engine steps comprising:

providing a plurality of fan assemblies wherein each fan assembly has a housing with an interior containing a fan blade rotatably connected within the housing and an exterior having six sides to form a hexagonal perimeter;

providing aerodynamic arcuate surface to transition from a hexagonal inner diameter on the back of the fan assembly to a circular inner diameter on the front of the fan assembly;

placing a first side of a first fan assembly adjacent a first side of a second fan assembly and a first side of a third fan assembly adjacent to a second side of the first fan assembly and a second side of the third fan assembly adjacent to a second side of the second fan assembly to form a cluster of fan assemblies; and placing the cluster of fan assemblies adjacent a radiator to control the air flow over the radiator and cool the radiator.

2. The method of claim 1 wherein the first side of the first fan assembly interconnects with the first side of the second fan assembly.

3. The method of claim 2 wherein the first side of the third fan assembly interconnects with the second side of the first fan assembly.

4. The method of claim 1 wherein the cluster of fan assemblies is affixed to an enclosure that ducts air flow from the fan assemblies to the radiator.

5. The method of claim 4 wherein the enclosure is five sided.

6. The method of claim 1 wherein the cluster of fan assemblies is placed adjacent to a plurality of radiators.

7. The method of claim 1 further comprising actuating the first and second fan assemblies simultaneously and then deactuating the first fan assembly only to provide less air flow to the radiator than when the first and second fan assemblies are actuated simultaneously.

8. The method of claim 1 wherein a wedge is disposed between the first and second fan assemblies.

* * * * *